US007274989B2

(12) United States Patent
Hopper

(10) Patent No.: US 7,274,989 B2
(45) Date of Patent: Sep. 25, 2007

(54) BOREHOLE EQUIPMENT POSITION DETECTION SYSTEM

(75) Inventor: Hans Paul Hopper, Aberdeen (GB)
(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 10/498,387

(22) PCT Filed: Nov. 27, 2002

(86) PCT No.: PCT/GB02/05349

§ 371 (c)(1),
(2), (4) Date: Oct. 7, 2004

(87) PCT Pub. No.: WO03/050390

PCT Pub. Date: Jun. 19, 2003

(65) Prior Publication Data

US 2005/0055163 A1 Mar. 10, 2005

(30) Foreign Application Priority Data

Dec. 12, 2001 (EP) ..... 01310376

(51) Int. Cl.
*G01V 1/40* (2006.01)
*G01V 3/00* (2006.01)
*E21B 47/09* (2006.01)

(52) U.S. Cl. ..... 702/6; 340/854.1; 166/255.1

(58) Field of Classification Search ..... 702/6; 166/250.01, 255.1, 359, 360, 367–368; 73/152.01; 175/5; 340/854.1, 853.1
See application file for complete search history.

(56) References Cited

U.S. PATENT DOCUMENTS 2,340,609 A 2/1944 Mestas ..... 177/351
3,103,976 A * 9/1963 De Vries et al. ..... 166/336
3,152,261 A 10/1964 Carlstein ..... 307/11
3,513,912 A 5/1970 Boop ..... 166/65
3,611,345 A 10/1971 Pintell ..... 340/280
3,843,923 A 10/1974 de Vries et al. ..... 324/228
3,936,733 A 2/1976 Clary ..... 324/262
4,206,810 A * 6/1980 Blackman ..... 166/336
4,468,959 A 9/1984 Roberts ..... 73/152.01
4,715,442 A * 12/1987 Kahil et al. ..... 166/250.01
4,737,709 A 4/1988 Loftus ..... 324/208
4,743,786 A 5/1988 Ichikawa et al. ..... 310/111
4,862,426 A * 8/1989 Cassity et al. ..... 367/81
4,922,423 A * 5/1990 Koomey et al. ..... 702/39
4,964,462 A * 10/1990 Smith ..... 166/255.1

(Continued)

*Primary Examiner*—John Barlow
*Assistant Examiner*—Toan M. Le
(74) *Attorney, Agent, or Firm*—Conley Rose, P.C.

(57) ABSTRACT

It is important to know the precise position of equipment when testing of the BOP, testing the wellhead, flow testing the well, kick control, well circulation and testing of spool trees between the wellhead and the BOP. Accordingly, there is provided a system for determining the real time position of equipment within a bore, the system including a data input means for inputting data concerning the physical characteristics of components which are run into the bore; a sensing means located, in use, within the bore and including a sensor for determining data concerning at least one physical characteristic of the equipment at a given time; a data storage means for recording the inputted data and the determined data; and a comparison means for comparing the input data and the determined data to establish which part of the equipment is being sensed by the sensor.

20 Claims, 10 Drawing Sheets

U.S. PATENT DOCUMENTS 5,014,781 A * 5/1991 Smith ..... 166/66.5
5,074,365 A * 12/1991 Kuckes ..... 175/40
5,323,856 A 6/1994 Davis et al. ..... 166/253
5,666,050 A 9/1997 Bouldin et al. ..... 324/207.26
5,740,863 A * 4/1998 Ortloff et al. ..... 166/368
5,826,654 A * 10/1998 Adnan et al. ..... 166/250.01
6,041,860 A * 3/2000 Nazzal et al. ..... 166/250.01
6,112,809 A * 9/2000 Angle ..... 166/66
6,325,159 B1 * 12/2001 Peterman et al. ..... 175/7
6,333,700 B1 * 12/2001 Thomeer et al. ..... 340/854.8
6,359,569 B2 * 3/2002 Beck et al. ..... 340/856.3
6,478,087 B2 * 11/2002 Allen ..... 166/255.1
6,561,022 B1 5/2003 Doyle et al. ..... 73/313
6,640,900 B2 * 11/2003 Smith ..... 166/336
6,712,160 B1 * 3/2004 Schultz et al. ..... 175/48
6,725,924 B2 * 4/2004 Davidson et al. ..... 166/250.01
6,815,945 B2 11/2004 Biester et al. ..... 324/207.24
6,895,678 B2 * 5/2005 Ash et al. ..... 33/313
6,989,764 B2 * 1/2006 Thomeer et al. ..... 340/853.2

* cited by examiner

BOREHOLE EQUIPMENT POSITION DETECTION SYSTEM

FIELD OF THE INVENTION

This invention relates to a system for determining the position of moving equipment within a bore such that, for example, an operator of a drilling system can determine the diameter, shape or orientation of the vertically moving equipment at specific locations within a well, especially at the wellhead and at the blow out preventer (BOP).

BACKGROUND TO THE INVENTION

When drilling in subsea applications, which can be at a water depth of as much as 10,000 feet (3,000 metres), it is important to know the location of the equipment with respect to the BOP, the wellhead, in the cased hole and in the bore of the drilled well. For example, it is important to know how equipment needs to be positioned in and along the bore for operations to be performed correctly.

The prime operations are: drilling the well, casing and cementing, well testing, completion and running any equipment inside the completion, a well workover and well intervention. In addition to the well operations, there are the system tests to check the integrity of individual systems and that they are performed as required. These may include the well, wellhead and BOP pressure tests and the BOP operating tests. A subsea well also creates additional complications in respect to a well kick operation or underbalance drilling (i.e. snubbing in or out of the hole) and the requirement to carry out an emergency disconnect and later the reestablishment of the well.

While carrying out all these operations from a floating vessel, it is important to know accurately, at any instant, the position of items of equipment within the system.

When drilling a subsea well, the prime pressure containing equipment that contains possible formation pressures includes the subsea wellhead, the casing which is hung from and cemented to the wellhead and the BOP on the wellhead.

A BOP assembly is a multi closure safety device which is connected to the top of a drilled, and often partially cased, hole. The accessible top end of the casing is terminated using a casing spool or wellhead housing to which the BOP assembly is connected and sealed.

The wellhead and BOP stack (the section in which rams are provided) must be able to contain fluids at a pressure rating in excess of any formation pressures that are anticipated when drilling or when having to pump into the well to suppress or circulate an uncontrolled pressurized influx of formation fluid. This influx of formation fluid is known as a "kick" and reestablishing control of the well by pumping to suppress the influx or to circulate the influx out under pressure is known as "killing the well". An uncontrolled escape of fluid, whether liquid or gas, to the environment is termed a 'blow out'. A blow out can result in major leak to the environment which can ignite or explode, jeopardizing personnel and equipment in the vicinity, and pollution.

Although normal drilling practices provide a liquid hydrostatic pressure barrier to a kick, a final second safety barrier is provided mechanically by the BOP assembly. The BOP assembly must close and seal on tubular equipment (i.e., pipe, casing or tubing) hung or operated through the BOP assembly and ultimately must be capable of shearing and sealing off the well. A general term for a tubular system run into the well is called a string. Wells are typically drilled using a tapered drill string having successively larger diameter of tubulars at the lower end. When running a completion or carrying out a workover, various diameter of tubulars, coiled tubing, cable and wireline and an assortment of tools are run. In addition, dual tubulars, or tubulars with pipes and cables as a bundle, must be considered.

A subsea conventional BOP assembly is attached to a wellhead and is provided with a number of rams either to seal around different set tubular diameters or to shear and seal the bore. These rams should be rated to perform at pressures in excess of any anticipated well pressures or kick control injection pressures which are approximately 10 to 15 kpsi (69-103 MPa). A minimum of one annular is provided above the rams to cater for any tubular diameter or for stripping in or out under pressure. An annular is a hydraulically energized elastometric toroidal unit that closes and seal on varying diameters of tubular member whether stationary or moving into or out of the well. Due to the nature of this pressure barrier element, a lower maximum rated working pressure of about 5 kpsi (34 MPa) is normally available.

Above the annulars, there are no further well pressure barrier elements with the riser only providing a hydrostatic head, liquid containment and guidance of equipment on a normal pressure controlled drilling operation. For a subsea riser system, the hydrostatic head of the different drilling liquids over the ambient sea water pressure means the low pressure zone above the subsea BOP assembly must still withstand hydrostatic pressures of, depending upon the depth of water, approximately 5 kpsi (34 MPa).

The conventional BOP assembly in effect provides a three zone pressure containment safety system. The three zones typically consists of the first high pressure lowermost section encompassing the rams, the medium pressure second zone having the annular or annulars and the low pressure third zone being the bore open to atmosphere and, on a subsea system, the riser bore to the surface vessel. Therefore it is critical that the correct rams are closed on the correct diameter and full pressure integrity is achieved. In an emergency disconnect it is important that, besides sealing on the pipe or tubular, the pipe is held and not dropped down the hole.

A BOP can be fitted with a ram or rams to suit various diameters of drill pipe, tubing or casing. Variable rams can be used, having carefully selected their range. A BOP is fitted with the rams mostly likely to be needed in a certain drilling/workover phase. If a stage is reached where an inadequate range of rams are in the BOP to handle the tools/equipment to be used in the next sequence, the BOP has to be pulled and appropriately redressed.

When drilling or carrying out well intervention on a subsea well where the wellhead is at the seabed, the subsea BOP attached to the subsea wellhead is connected to a buoyant floating drilling vessel by a riser. A floating drilling vessel should maintain its station vertically above the well to enable well operations to be performed.

Failure to do so caused by weather conditions, current forces, equipment malfunctions, drift off or drive off, fire or explosion, collision of other marine incidents means it is necessary if possible to make the well safe, isolate the well at the seabed and disconnect the riser system. In a severe emergency, shearing any tubulars or equipment in the BOP bore, sealing the well to full working pressure and disconnecting the riser system is required to be achieved in under 30 seconds.

At present, in order to know what components are run through the drill floor, a manual record of the relevant dimensions, such as the length and the diameter of components are logged. These records are typically made in a notebook before being totalled up. Mathematical errors can occur easily during the totaling or components can be left out of the tally entirely or additional equipment, over and above that scheduled to be run, run in through the rotary table can be ignored or forgotten. Therefore, on a number of occasions, the accuracy of the tally is questionable.

Furthermore, as there are a wide variety of components which can be run in the hole, often with minor variations in length for what otherwise appear to be identical components, it is important that each component is measured individually before it is attached to the string. It is easy for minor errors in measurement of each component to add up to a significant error over the length of the string.

A further problem is that even when the measurements are accurately taken at the rig, these measurements are passive, i.e. on unstressed dimensions of the component. Once the component has been run in on a string, it may have 5,000 metres of additional components hanging from its end and, although this would not produce a significant change in length of a single component, when the total change is added-up over all components of the drill string, the change can be significant.

Furthermore, as the riser extending between the wellhead and the drill rig may be 2000-3000 m in length, it is subject to subsea currents and may be caused to "snake" between the rig and the wellhead. In this case, the length of drill string run into the riser is not directly comparable to the straight distance between the rig and the wellhead.

Additional problems are encountered as the drilling rig heaves on the sea surface such that its position, which is dependent on the tide and the vessel draft, is constantly changing with respect to the sea bed. This can, in part, be compensated for by the use of telescopic joints and a travelling block, but these additional factors need also to be included in any calculation of the position of the string. As the rig can heave in a matter of seconds, it can, in rough conditions, be impossible to determine accurately the position of the string given that the calculations required at present are cumbersome and complex.

It is critical at certain instances to know the position of equipment in the hole and, on a floating vessel, this requires knowledge of the tally, water depth, the draft and any change of draft of the vessel, swell or tidal heave, position of the travelling block, the stroke of the compensator and the depth of hole drilled since the last summation was made. This does not take into account snaking of the riser due to currents or cross currents in deep water, or the extension of the tubular string due to tension and weight. It is therefore difficult to determine accurately what component is at any given depth in a quick and accurate manner.

An example outlining a subsea well operation is an emergency disconnect involving the drilling string.

The accurate position of the drill string is required in the event of an emergency shut in of the BOP by closure of, for example, the shear blind rams in the BOP stack. The shear blind rams are those which can cut the drill string or a pipe or tubing and then seal the BOP bore when there is a need to carry out an emergency disconnect of the riser system from the BOP stack. The shear blind rams are activated with only a set force and therefore, should the rams close on a section of equipment which is significantly larger than the shear capability of the rams, for example on a joint between adjacent pipe sections, the rams may not fully sever the drill string thereby not closing sufficiently to seal the well and allow an emergency disconnect to be carried out correctly. To prevent the drill string falling down the hole, and to enable the drill string to be available to kill and circulate the well on reconnection, it is very advisable to be able to hang the drill string off on a set of pipe rams. This is achieved by resting an up-set diameter of the string on a set of pipe rams below the blind shear rams.

For operations of this sort, it is necessary to know the position of a specific part of the drill string to approximately one metre over anything up to 3,000 metres:

Further examples in which it is important to know the precise position of equipment is in testing of the BOP, testing the wellhead, flow testing the well, kick control, well circulation and testing of spool trees between the wellhead and the BOP.

Accordingly, it is an aim of the present invention to provide a system which enables the above problems to be overcome and allows the operator of the drilling system to know the precise position of a string, which may be moving, relative to a section of the well, the BOP or the wellhead at any given moment.

SUMMARY OF THE INVENTION

According to the present invention, there is provided a system for determining the real time position of equipment within a bore, the system comprising:

a data input means for inputting data concerning the physical characteristics of components which are run into the bore;

a sensing means located, in use, within the bore and including a sensor for determining data concerning at least one physical characteristic of the equipment at a given time;

a data storage means for recording the inputted data and the determined data; and a comparison means for comparing the input data and the determined data to establish which part of the equipment is being sensed by the sensor.

Preferably, the information input to the data input means includes the length, shape and/or diameter(s) of components making up the equipment and run in or out of the bore. Many components may have multiple changes in diameter over their length and it is important that all such information is entered into the data input means.

Thus, the present invention provides a system by which the exact signature profile of the equipment is recorded as it is run into or out of the bore and a sensor, located at the relevant location in the bore, provides information relating to changes in a known physical characteristic of the equipment. By comparing the sensed data and the known data, it is possible to work out which part of the equipment is adjacent to the lower sensor and therefore the position of the equipment relative to the BOP and the wellhead.

Preferably, the information input to the data input means also includes the distance between the changes in diameter, either along a single component or between diameters on adjacent components. Preferably, the sensor determines the shape and/or diameter of the equipment at a given time.

The sensing means preferably includes a means for determining the distance between successive changes in diameter.

Preferably, the system further comprises a sensing means for determining the direction of travel of the equipment in the bore and this may be part of the downhole sensor or a vessel based sensor.

The system may be used on a subsea bore having a wellhead with a BOP connected to it, which, in turn has a riser connected to it which, in turn, is connected to a drilling rig having a telescopic joint, a derrick, a travelling block/compensator and draw works.

Preferably, a further sensor is located, in use, in the upper portion of the riser fixed to the vessel to determine the profile of the equipment as it is run into the riser system.

Furthermore, it is preferable that a travel sensor is located on the telescopic joint to measure the movement of the telescopic joint between the floating drilling vessel and the top end of the riser linked to the seabed or to compute the travel from a line travel sensor on a riser tensioner line.

Another variable is movement in the derrick between the connection to the equipment and the vessel caused by the compensator stroking and operations of the draw works. A location sensor on the lower part of the compensator relative to the derrick could be considered. A physical means would be to monitor the stroking of the compensator with a travel sensor and to register the position of the travelling block in respect to the derrick. A method is to monitor line travel of the drill line from the draw works to the travelling block taking account of the number of sheaved lines to obtain the true travel.

The data input means is preferably a further sensor of the type used in the bore and it can therefore measure accurately the diameters and the lengths of all equipment run or pulled through the drilling vessel's drill floor. This information can be enhanced by referencing detailed product specifications which could include internal diameters, type of connection, strength and identification number. This would then provide a cross reference between what is actually run and what was scheduled to be run.

With an accurate knowledge of the equipment's signature profile and additional information, the sensor in the bore actively monitors the motion of the equipment relative to the fixed position of the sensor and therefore relative to the wellhead. By combining these two sources of information with the well, wellhead, BOP configuration data, the position of any item of equipment can be related to any point in the well.

Using a microprocessor to collate this information/data, an active animated visual display may then be produced on a visual display device, such as a monitor, at a choice of scales most suited for the operation at the desired section of the well system.

This invention described in respect to a subsea drilling BOP can equally be applied to workover BOPs, wireline or coil tubing BOPs. Equally the system can cater for wire, cable or coil tubing operations by recording the length of cabling run past a line travel sensor.

A surface sensor, that is one on the drilling rig, may be provided to register the length of individually made up items of equipment. The reason for this is that in certain circumstances, a section of the equipment run into the bore may be made up of a plurality of tubulars which, when joined to each other, have a continuous outer diameter (ie external flush drill collars and liner pipes). The surface sensor can register their lengths as the joints are made up although a string sensor lower down the riser would not be able to detect any diameter or shape change.

Once the wellhead with the surface casing string, BOP and riser system is run, all subsequent casing strings and the drilling strings used to drill the next section of hole can also be recorded. This will allow an accurate elevation of casings within casings in the well at any depth to be formulated as casing strings are run and cemented inside the previous casing.

The ability of the bore sensors to monitor the shape and orientation means that when, carrying out certain down hole tasks, the number of rotations of the equipment can be registered at the BOP sensor, rather than having to rely on knowledge of the number turns made at the surface. The problem with relying solely on the information from the surface is that there may be some relative twist on the equipment run, such that, for example, ten turns at the surface only corresponds to five turns at the sensor.

By combining a knowledge of the time a string has been in its position and how much it has been rotated, likely wear characteristics in the riser or in the cased hole can be predicted and may then be reduced.

The down hole sensor(s) is (are) preferably located in a retrievable part of the LRP/riser system, such as the low pressure area of the BOP/riser, thereby allowing easier maintenance, service and repair. Additionally no disconnect and make-up interface is required compared with a BOP stack mounted sensor system.

BRIEF DESCRIPTION OF THE DRAWINGS

One example of the present invention will now be described with reference to the accompanying drawings, in which.

DESCRIPTION OF PREFERRED EMBODIMENTS

Figure 1:
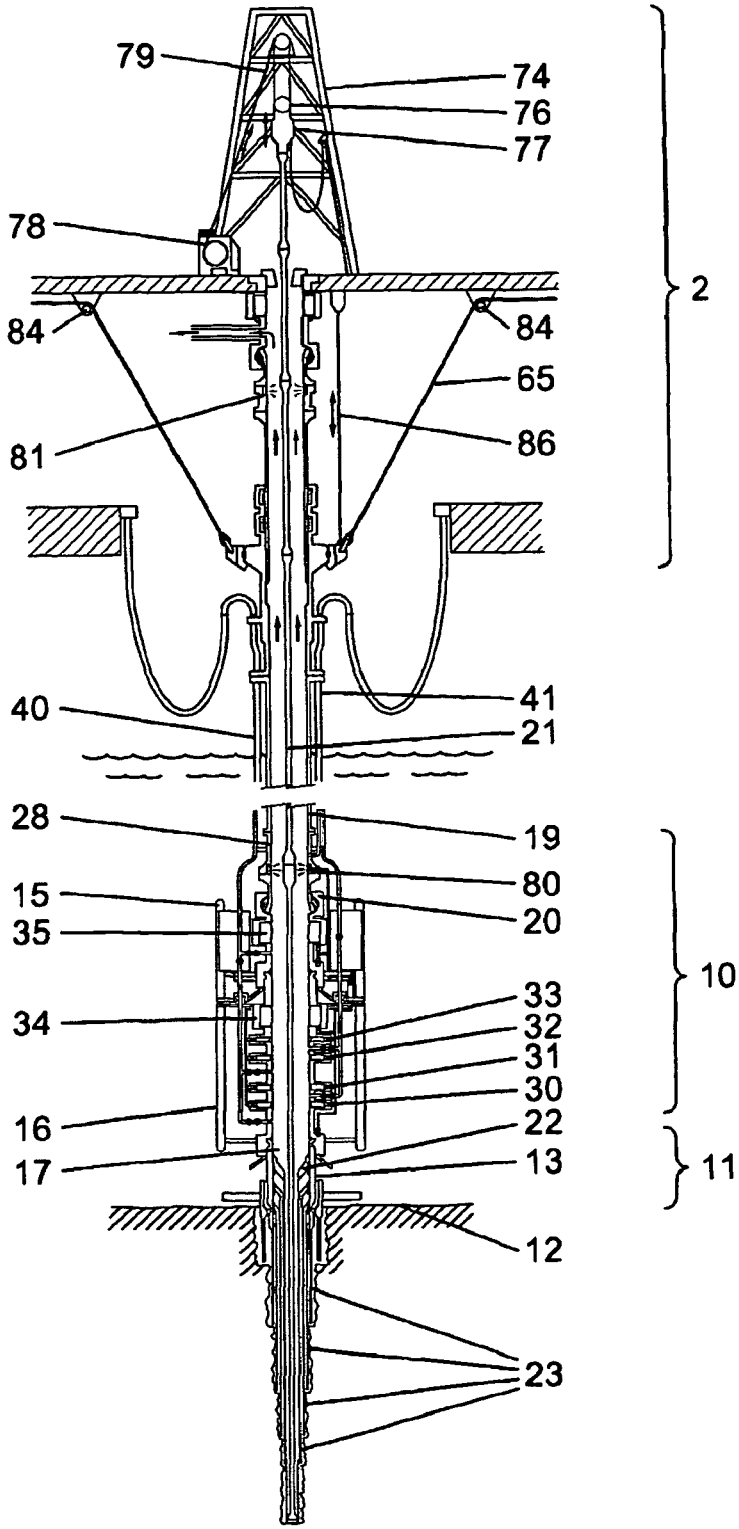
FIG. 1 is a schematic longitudinal cross sectional view through a subsea well being drilled by a floating vessel showing the well, wellhead, subsea BOP, riser and drilling rig incorporating the present invention.
Figure 2:
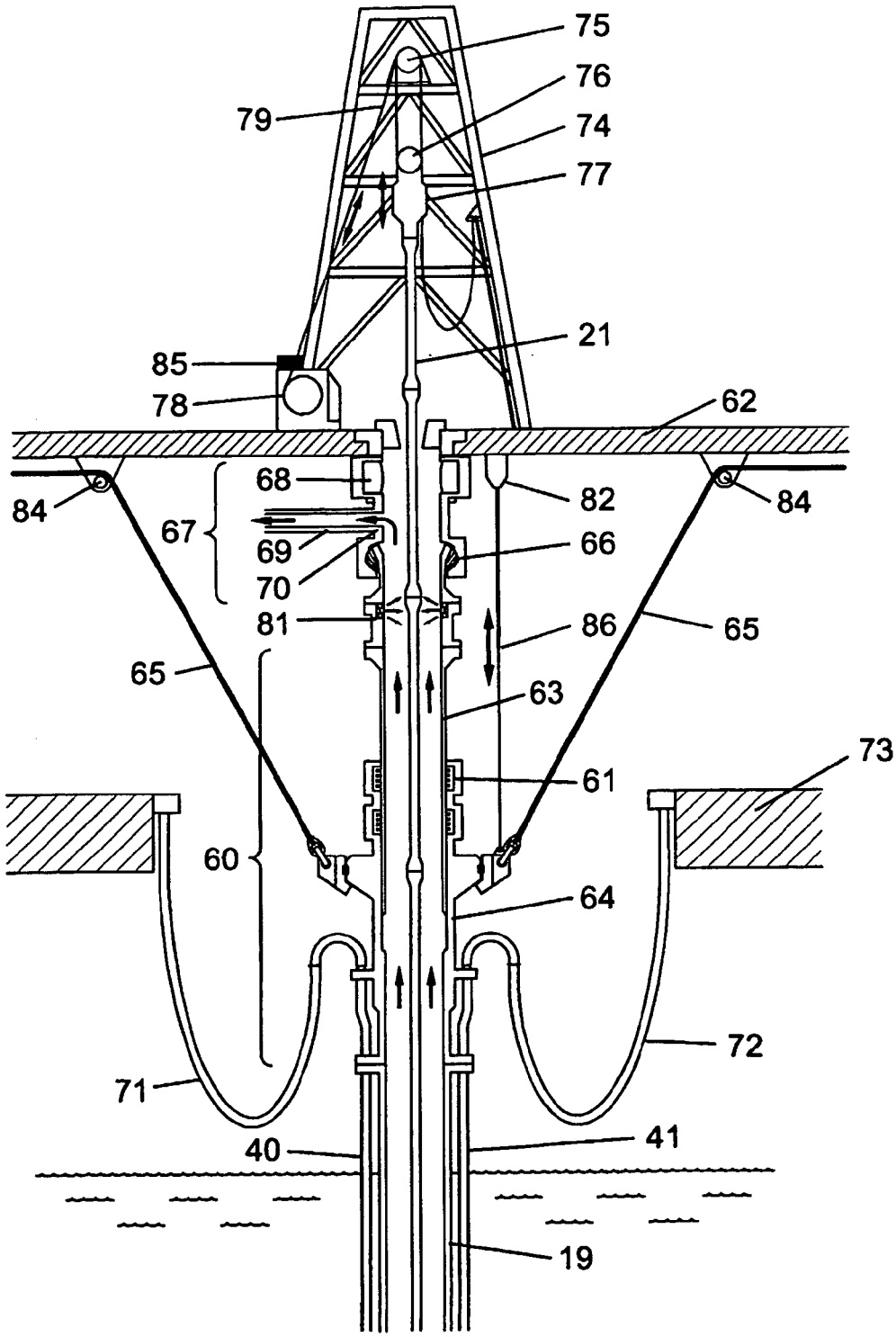
FIG. 2 is a schematic longitudinal cross sectional view of the drilling rig top side of FIG. 1.
Figure 3:
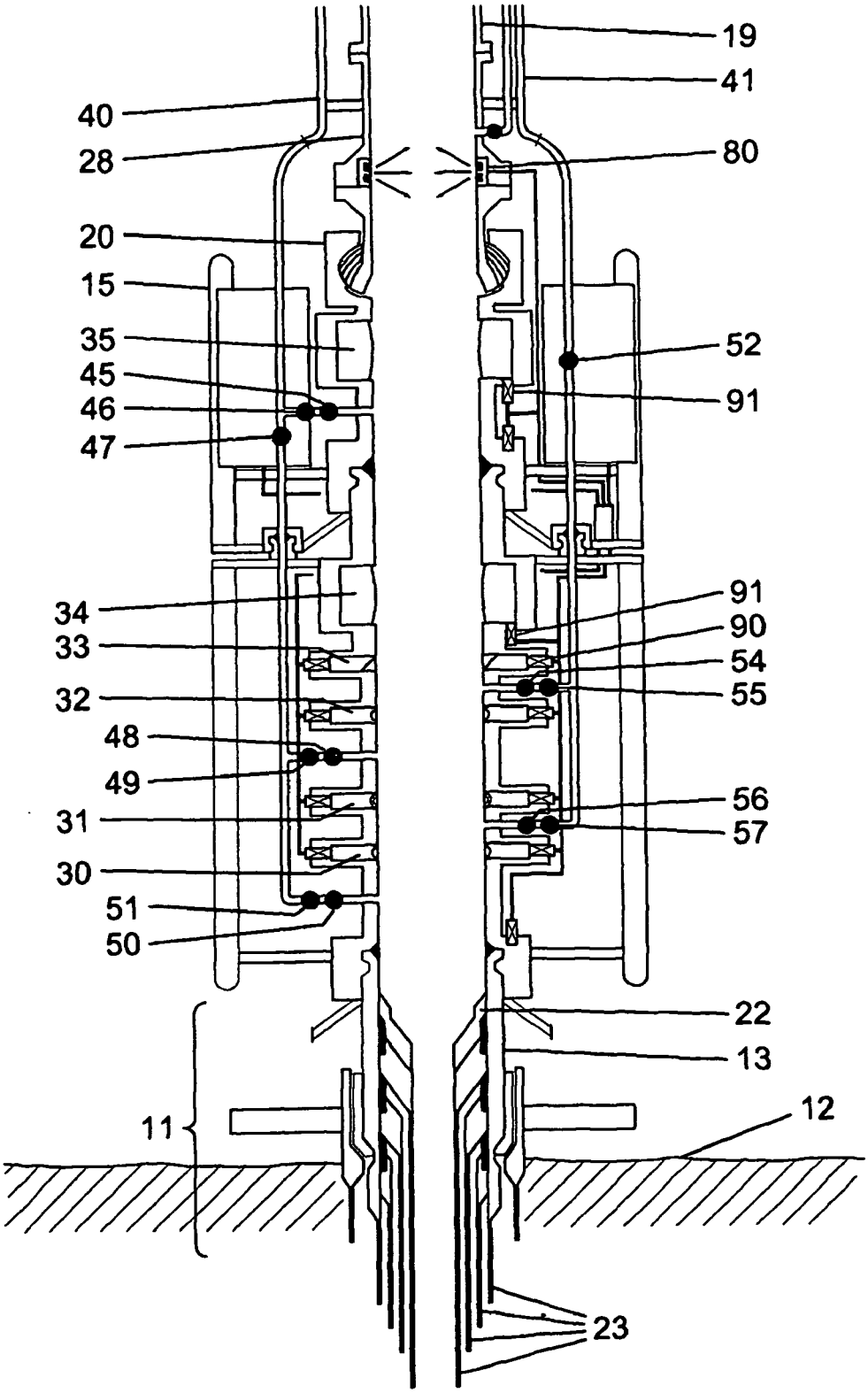
FIG. 3 is a schematic longitudinal cross sectional view of a typical subsea BOP of FIG. 1.

A drilling rig 2, a subsea BOP assembly 10 and wellhead assembly 11 is shown schematically in FIGS. 1 to 3. A wellhead assembly 11 is formed at the upper end of a bore into the seabed 12 and is provided with a wellhead housing 13. The BOP assembly 10 is, in this example, comprised of a BOP lower riser package (LRP) 15 and a BOP stack 16. The LRP 15 and the BOP stack 16 are connected in such a way that there is a continuous bore 17 from the lower end of the BOP stack through to the upper end of the LRP. The lower end of the BOP stack 16 is connected to the upper end of the wellhead housing 13 and is sealed in place. The upper part of the LRP 15 consists of a flex joint 20 which is connected to a riser adaptor 28, which is, in turn, connected to a riser pipe 19. The riser pipe 19 connects the BOP assembly 10 to a surface rig 2.

Within the bore 17 and the riser pipe 19, a tubular string 21 is provided. Such a string is comprised of a number of different types of component including simple piping, joint members, bore guidance equipment, and may have attached at its lower end, a test tool, a drill bit or a simple device which allows the flow of desired fluids from the well. The wellhead housing 13, as an example, is shown with one wear bushing 22 and a number of well casings 23 which have previously been set in the wellhead and which extend into the hole in the sea bed 12.

The BOP stack is provided with a number of valve means for closing both the bore 17 and/or on the string 21 and these include lower pipe rams 30, middle pipe rams 31, upper pipe rams 32 and shear blind rams 33. These four sets of rams comprise the high pressure zone in the BOP stack 16 and they can withstand the greatest pressure. The lower, middle and upper pipe rams are designed such that they can close around the string 21. However, the rams are only designed to close around a specific diameter of the drill string, for example on a 5 inch (125 mm) pipe section, and it is therefore important to know, in the event of, for example, an emergency disconnect, whether or not the rams are opposite a suitable section of the drill string 21 to enable them to close correctly and provide a seal.

Of course, when the lower 30, middle 31 and upper 32 pipe rams are closed, whilst the bore 17 is sealed, the bore of the drill string 21 itself is still open. Thus, the shear blind rams 33 are designed such that, when operated, they can cut through the drill string 21 and provide a single barrier between the upwardly pressurized drilling fluid and the surface.

Above the shear blind rams 33, a lower annular 34 and an upper annular 35 are provided and these can also seal around the drill string 21 when closed and provide a medium pressure zone.

The lower pressure zone is located above the upper annular 35 and includes the flex joint 20, the riser adaptor 28 and the riser 19. The low pressure containing means of this zone is merely the hydrostatic pressure of the fluid which is retained in the bore open to the surface.

Extending from the surface rig 2 to the BOP assembly 10 are choke 40 and kill 41 lines for the supply of fluid to or from the BOP. The choke line 40 is, in this example, in fluid communication with the bore 17, in this example, three locations, each location having an individual branch which is controlled by a pair of valves (see FIG. 3). The uppermost valves are inner 45 and outer 46 gas vents and the branch on which they are located extends to the bore 17 below the upper annular 35. The choke line 40 extends, passing in and out of gas vents, through a choke test valve 47 and enters the bore 17 via upper, inner 48 and outer 49 choke valves above the middle pipe rams 31 and via lower, inner 50 and outer 51 choke valves below the lower pipe rams 30.

On the opposite side of the BOP stack, the kill line 41 is equipped with a kill test valve 52 before the kill line 41 enters the bore 17 at two locations, again each of which is via a pair of valves; upper, inner 54 and outer 55 kill valves and lower, inner 56 and outer 57 kill valves respectively. The upper branch is between the upper pipe rams 32 and the shear blind rams 33 and lower branch is between the lower 30 and middle 31 pipe rams.

The drill rig 2 is connected to the riser 19 by means of a telescopic joint 60 (see FIG. 2). In this example, the upper end 61 of the telescopic joint 60 is spaced vertically from the lower surface of the drill floor 62 of the drill rig 2 and, as such, extending from the lower surface of the drill floor, there is provided a telescopic joint outer barrel 64 which extends into, and in sealing engagement 61 with, the telescopic joint outer barrel 64 of the telescopic joint 60. As the drill floor moves vertically relative to the outer barrel 64 of the telescopic joint 60, the inner barrel 63 can slide within a recess portion of the outer barrel 64. The telescopic joint 60 is suspended from the drill floor 62 by means of riser tensioner cables 65 which are connected, via sheaves 84, to motion compensating tensioners (not shown). The upper end of the inner barrel 63 is connected to a flexible joint 66 which, in turn, which forms the diverter assembly 67 extending below the lower surface of the drill floor 62. The diverter assembly annular 68 is provided to seal the bore 17 if necessary. Drilling mud which passes up the riser 19 is directed through a mud outlet 69 through a flow nipple 70. The choke and kill lines 40,41 are connected to respective flexible choke and flexible kill 71, 72 lines which extend on to the main deck 73 of the rig 2 and connect to the manifold and a high pressure pumping system.

On the upper surface of the drill floor 62, there is a derrick 74 which supports a set of sheaves 75 known as the crown block. The travelling block 76 is connected to a compensator and possibly a top drive assembly 77 which is, in turn, connected to the string 21. The crown block 75 and the travelling block 76 are connected by a cable 79 which is connected into draw works 78.

A number of sensors are included in the BOP 10 and the drilling rig 2. These include a riser adaptor bore object sensor 80 which is located at the upper end of the LRP 15 and a telescopic joint bore object sensor 81 which is located at the upper end of inner barrel 63. Each of these sensors can detect the diameter, shape and orientation of the string 21 which is within the sensor and they can transmit the information electronically to a centralized data collection means and a microprocessor (not shown). The sensors 80 and 81 thereby provide a series of measurements which can be used in determining the location of the string 21 at any given time. In particular, the telescopic joint bore object sensor 81 provides a sequence of measurements, especially the diameters, changes in diameter, shape and orientation of the string 21, as it is run into the riser 19 and provides reference data for later comparison. The riser adapter bore object sensor 80 detects the diameters and changes in diameter the shape and orientation of the string 21 as it passes the sensor 80 near the BOP 10. By comparing the sequence of diameters and diameter changes measured by the riser adaptor bore object sensor 80 with the reference data provided by the telescopic joint bore object sensor 81, the processor on the rig can determine which section of the drill string which is within the BOP at any given time.

The BOP 10 may also be provided with ram travel sensors 90 located on each ram of the lower 30, middle 31, upper 32 pipe rams and on the shear blind rams 33. Additionally, annular travel sensors 91 can be provided on the lower 34 and upper 35 annulars. In particular, the sensors can determine whether or not each of the rams or annulars has been activated, and if so, whether the ram or annular is in the correct position for sealing around the string 21.

Further sensors can be provided to measure other movement, such as heave of the rig, which would affect the location of the string relative to the BOP.

For example, a heave sensor 86 is provided between the drill floor 62 and the telescopic joint outer barrel 61 to account for variations due to heave of the rig. Additionally a mechanical travel sensor is included on the compensator/top drive assembly 77 to take account of the movement the compensator. The position of the travelling block 76 is known by the use of a line travel sensor 85 in the draw works 78.

An example description of the how the system can operate is shown in FIGS. 4 to 8. The example taken is an emergency disconnect of the vessel from the well between the BOP stack and the LRP.

Figure 4:
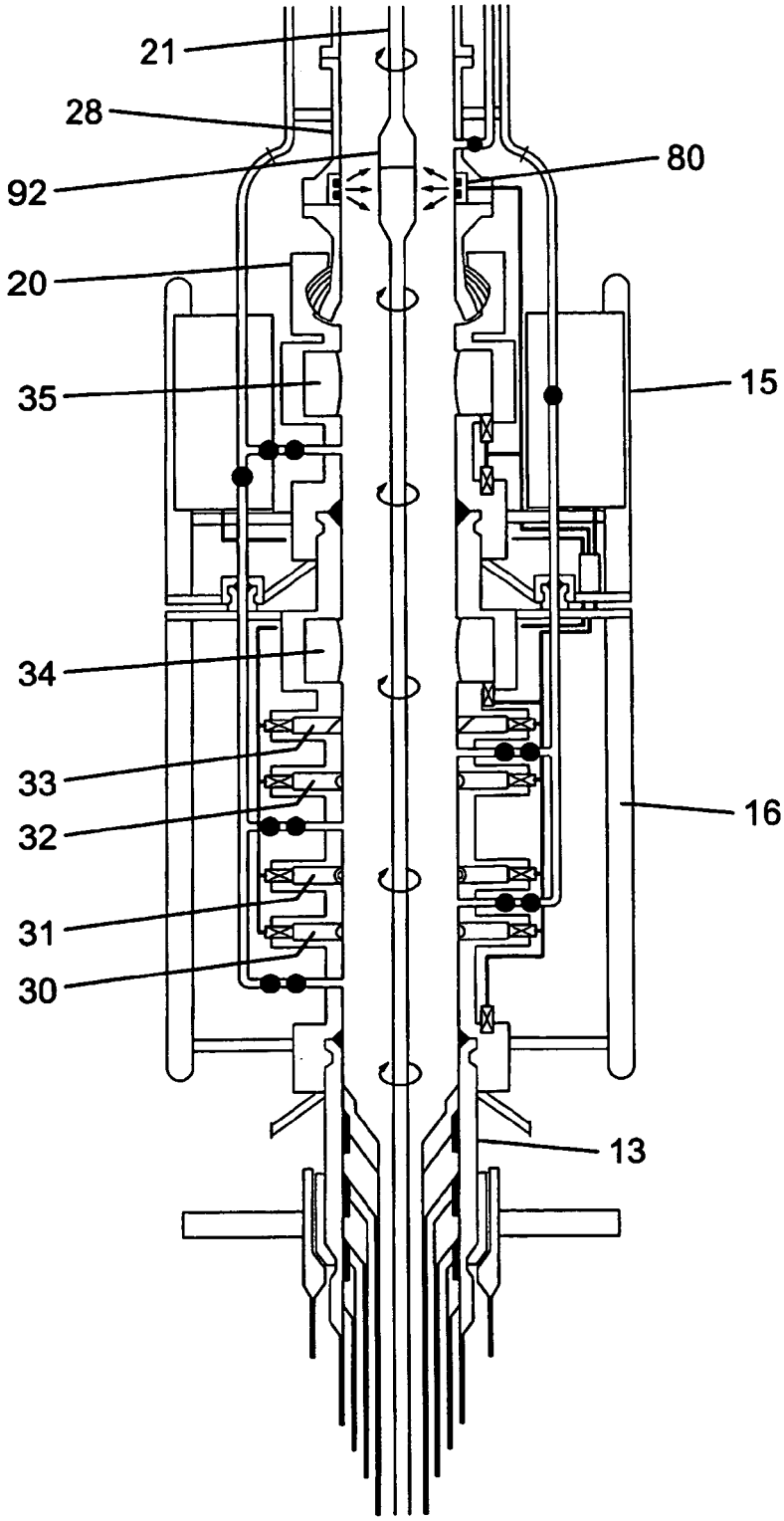
FIG. 4 is a schematic longitudinal cross section through the BOP of FIG. 1 during normal drilling.
Figure 5:
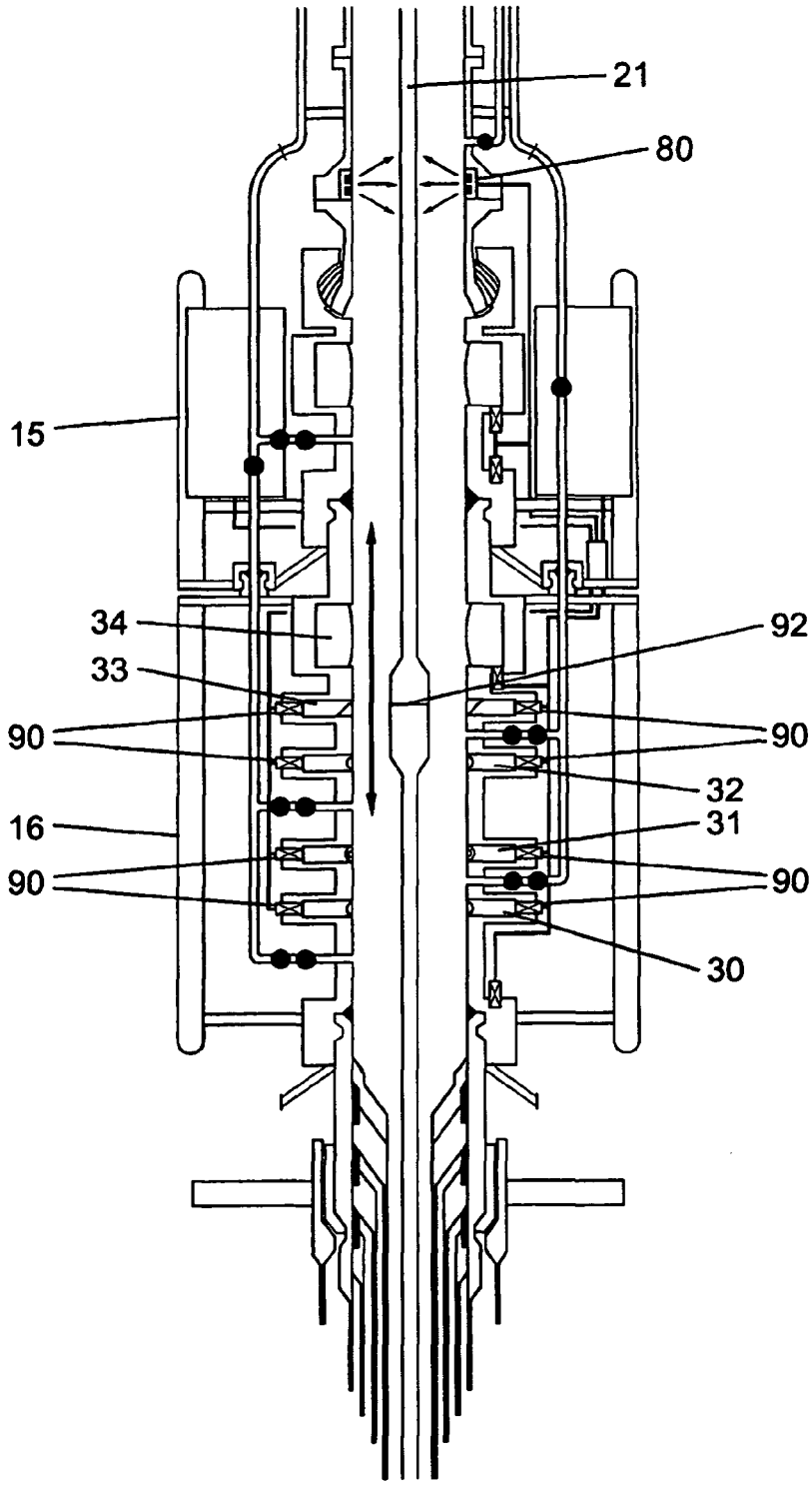
FIG. 5 is a schematic longitudinal cross section through the BOP of FIG. 1 at the start of an emergency disconnect.

FIG. 4 shows a cross sectional view through the BOP when a drill string 21 is operating in a conventional drilling mode and is rotating. In this situation, the riser adaptor bore object sensor 80 can detect changes in diameter of the tool joint 92, in this case, an increase in diameter, and this information would be relayed to the data storage means (not shown). In this example, the change in diameter at the tool joint 92 is effected by a section in which the diameter changes gradually from the smaller main pipe diameter to the larger diameter of the joint 92. In this case, both sides of the tool joint are provided with the same profile but, if different profiles were used on each side of the tool joint 92, it would be possible to determine in which direction the drill string 21 was moving as it passed the sensor 80 by detecting the shape of the profile of the diameter change. Alternatively, an additional sensor or an array of vertical sensors (not shown) could be provided to sense the direction and distance of travel of the string 21. The ability to know the direction and distance of travel is of considerable importance in determining the section of string which is adjacent to the sensor 80 and therefore what profile is currently in the BOP.

FIGS. 5 to 8 show how, after determining the location of the string 21 within the BOP 10, and therefore whether or not any tool joints 92 are present, an emergency disconnect can then be safely carried out. In this example, the rotating drill string 21 is monitored by the sensor 80 and the tool joint 92 is observed to be moving relative to the BOP. The location and operating status of the rams and annulars can be confirmed, by using the sensors 90 and 91, to be in the fully retracted positions.

When a rapid controlled emergency disconnect is required, the drill string 21 is picked up until the tool joint 92 is above the lower pipe rams 30 and rotation is stopped. The drill string 21 is held in this position and confirmation is obtained that the tool joint is above those rams. The lower pipe rams 30 are then lightly closed and the sensors 90 connected to the lower pipe rams 30 can confirm the correct closure of the rams on the drill string 21. The lower pipe rams 30 are closed only under a low operating pressure at this stage.

Figure 6:
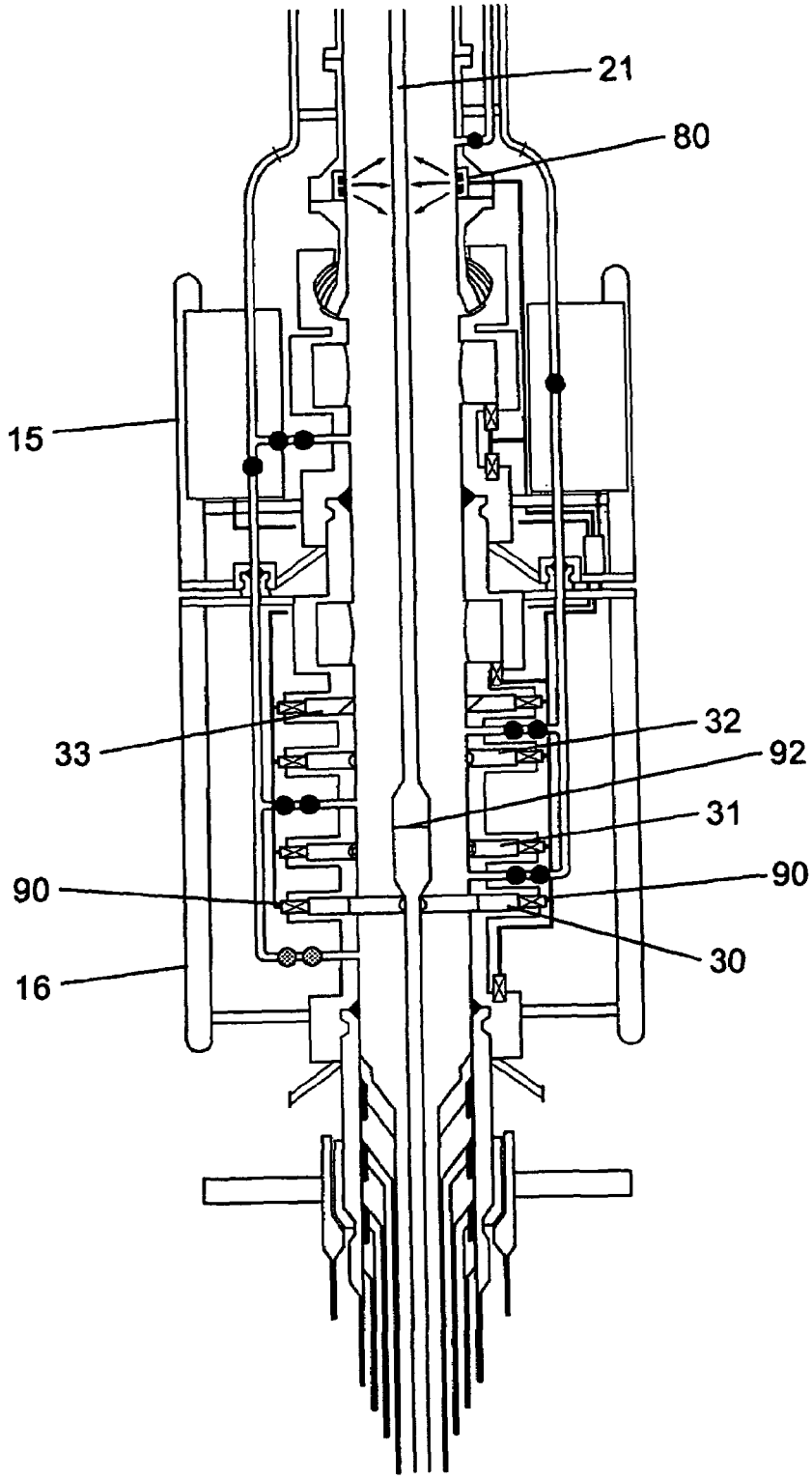
FIGS. 6 and 7 are schematic longitudinal cross sections through the BOP of FIG. 1 during the emergency disconnect.

Then the drill string 21 is lowered such that the tool joint 92 rests on the upper surface of the lower pipe rams 31 which will now support the drill string (FIG. 6). This can be detected by a loss of drill string weight recorded at the surface. At this stage, full ram close pressure is then applied to the lower pipe rams 30. The sensors 90 can again confirm that the rams are fully closed around the drill string 21. If present, ram locks (not shown) can be operated to prevent the lower pipe rams 30 from being forced apart.

Figure 7:
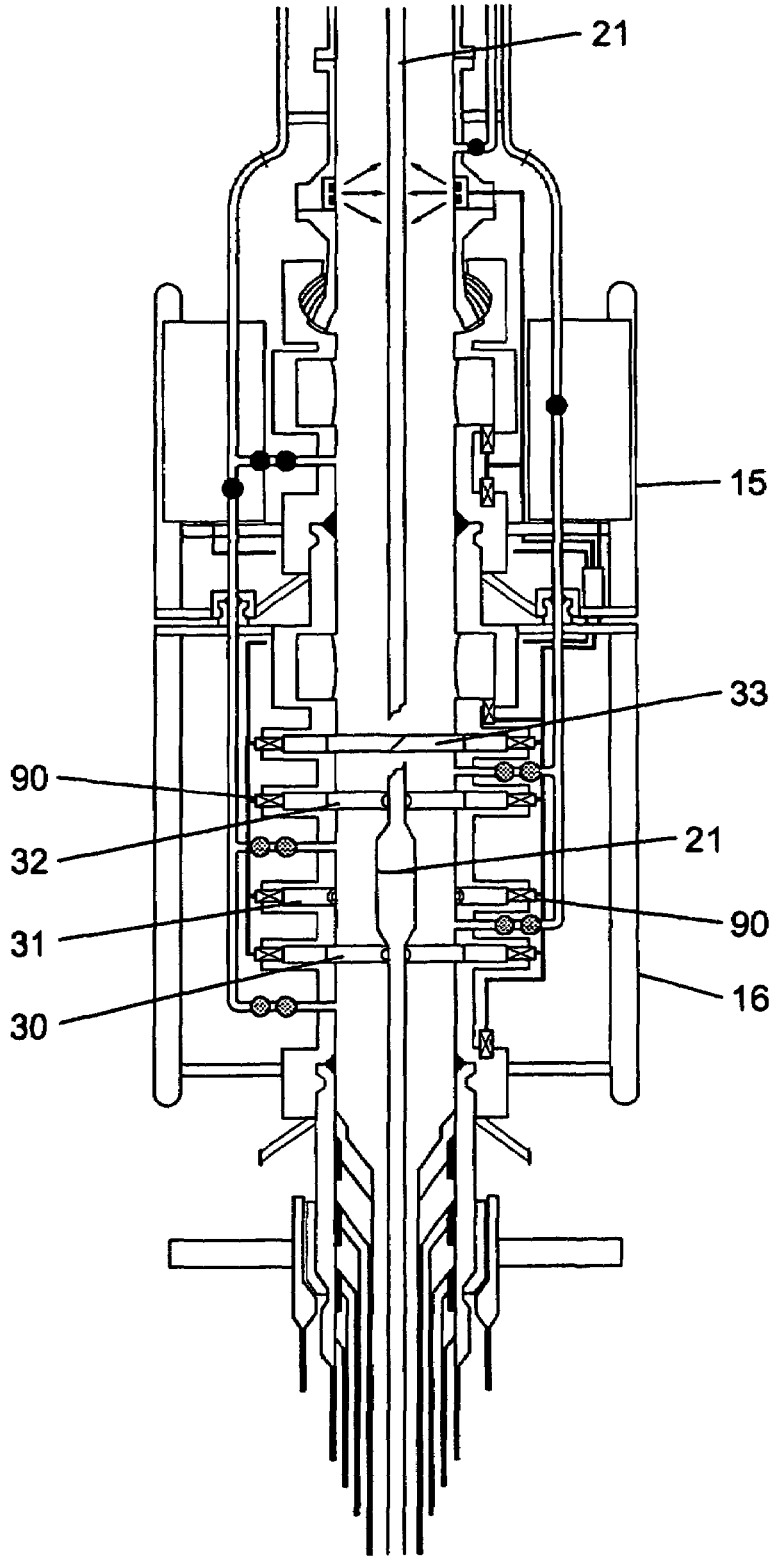

A similar operation can then be carried out on the upper pipe rams if the diameter of drill string across the closure point of the upper pipe rams 32 is suitable (see FIG. 7).

Next, the shear blind rams 33 can be closed, cutting the string 21, with the upper part being pulled up. Again this can be confirmed by the use of sensor 90. The ram locks, if present, can also then be activated.

Figure 8:
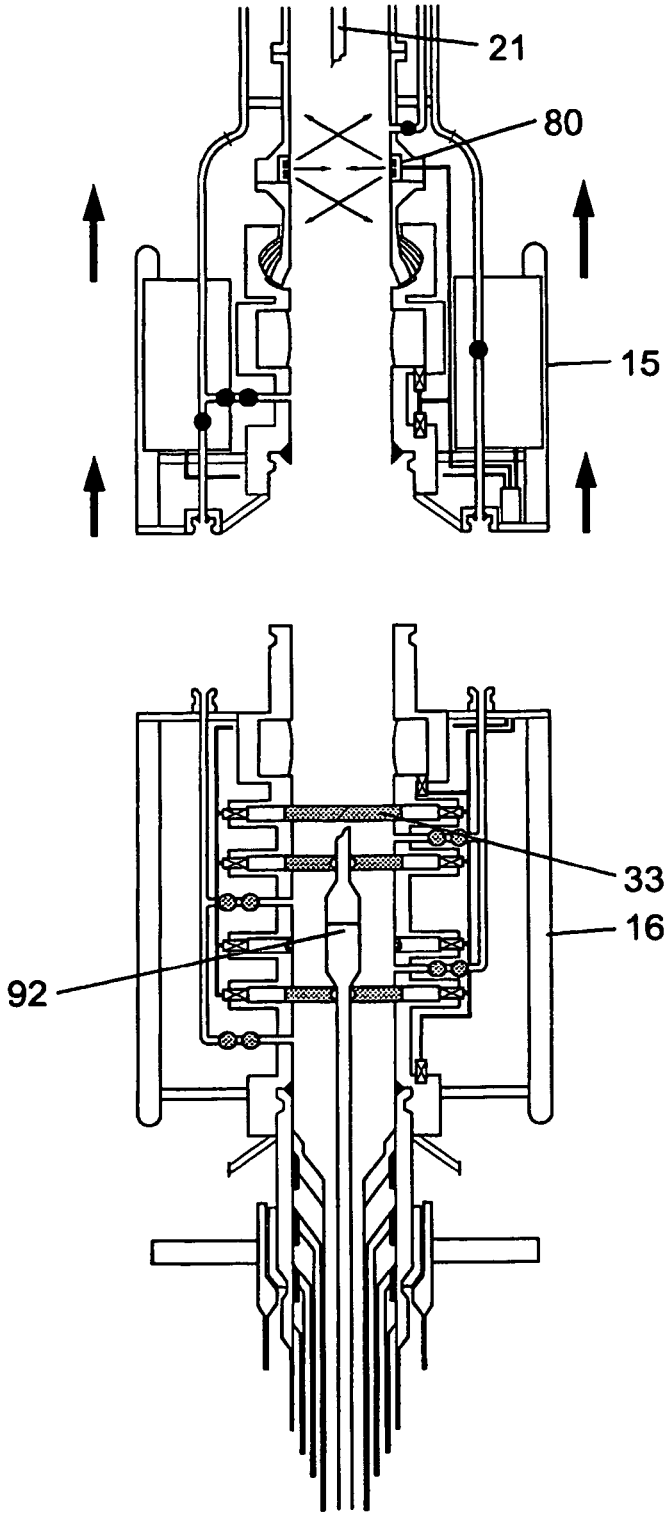
FIG. 8 is a schematic longitudinal cross sectional view through the BOP of FIG. 1 after the emergency disconnect.

The lower riser package 15 can then be disconnected from the BOP stack 16 and pulled clear of the remaining subsea components (FIG. 8).

The current method is to take the drill string position from the drillers tally and then account for heave, for vessel draft, for the position of the travelling block, note if the rig is off center, and then estimate the positions of the tool joints. Using the bore equipment detection system operating a drill floor monitor, and displaying a visual presentation, the driller can visually observe the situation at any given time.

Figure 9:
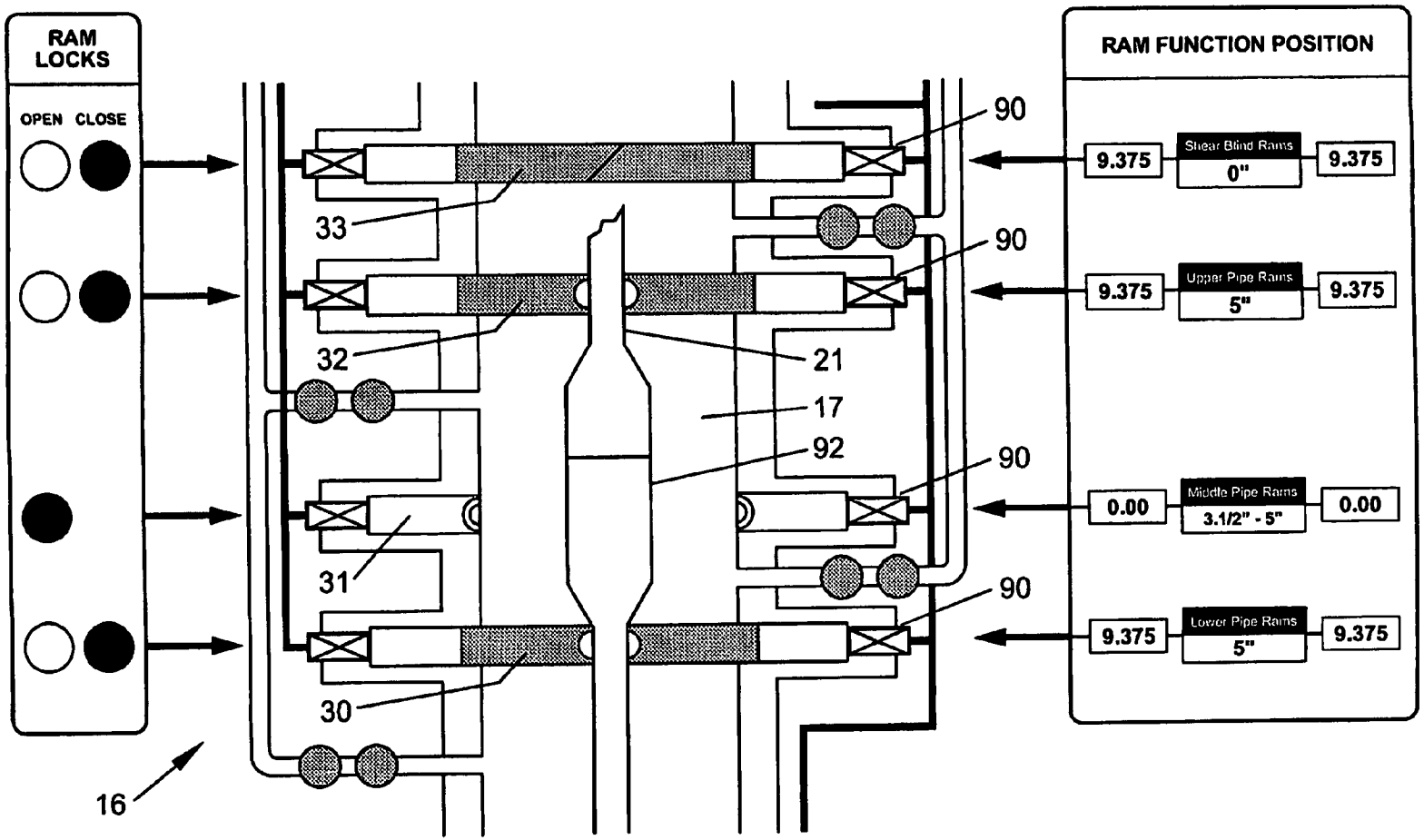
FIG. 9 is a schematic longitudinal cross sectional view through part of the BOP after an emergency disconnect showing the status of the rams and the valves.

FIG. 9 shows a typical exploded display that could be displayed on a drill floor monitor (not shown) and gives a view of the lower 30, middle 31 and upper 32 pipe rams after an emergency disconnect has been carried out. In this example, the lower 30 and middle 31 variable pipe rams have been closed on the smaller diameter of the main drill string 21 and the ram lock would be in the closed position. Additionally, the shear blind rams 33 would also be closed and again the ram locks would be in the closed position. However, the middle pipe rams 31 have not been operated and therefore the ram locks would still be in the open position. This form of checking would be carried out at all stages within the emergency disconnect procedure to ensure that each ram and annular was in the appropriate position for that stage of the operation.

Figure 10:
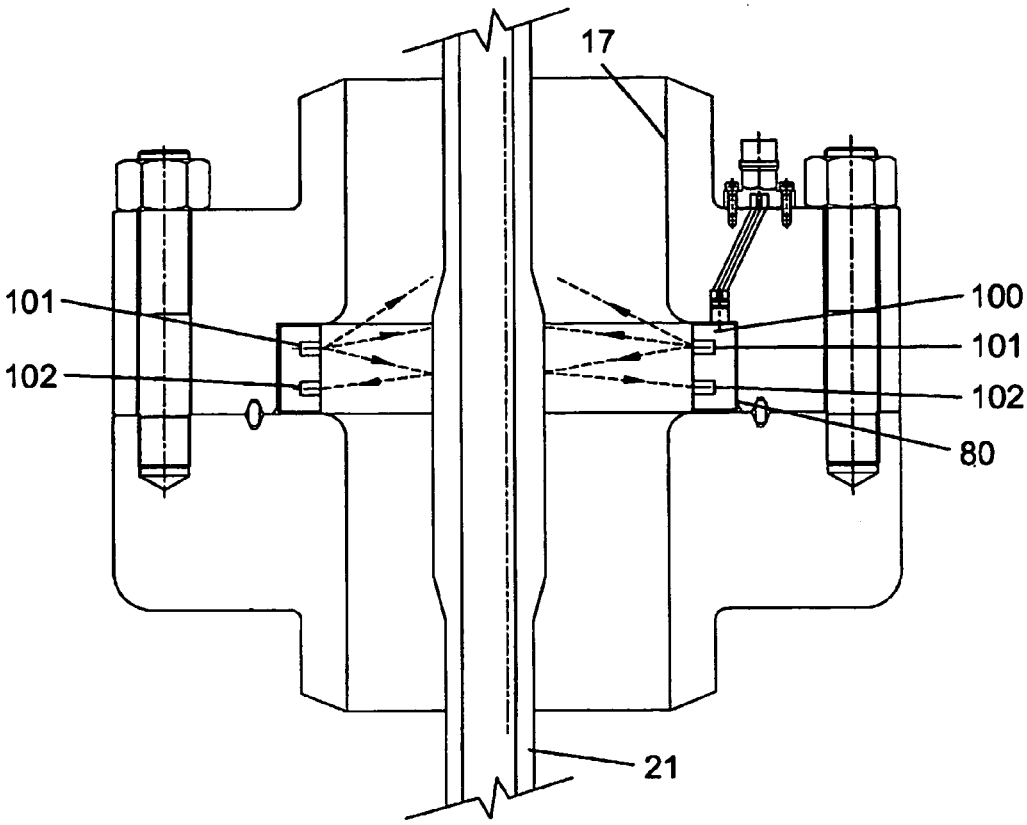
FIG. 10 is a vertical schematic cross section view through one example of a sensor which could be used as part of the present invention.
Figure 11:
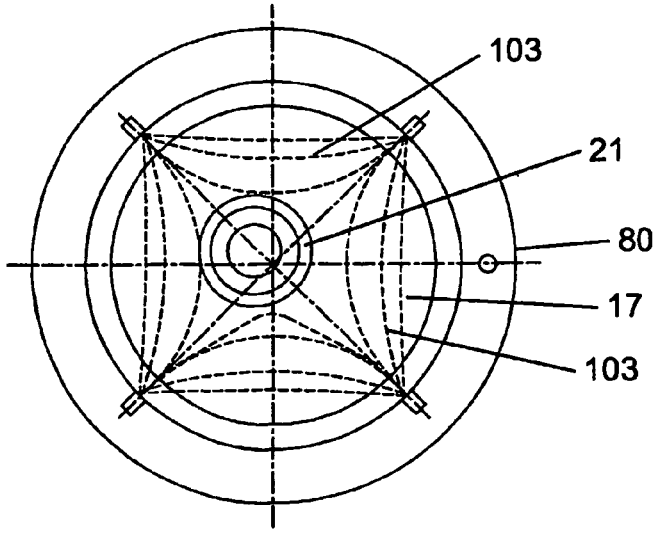
FIG. 11 is a horizontal schematic cross-sectional view of the sensor of FIG. 10.

FIGS. 10 and 11 shows a close up view of one of the bore object sensors 80 or 81. The sensor is an electronic/magnetic sensor that can determine electronically and accurately the diameter of a body within the bore 17 and its location within the bore, i.e. if the tubular string or strings is on one side of the bore, thereby indicating that the rig may not be vertically above the wellhead. A full string signature profile can be obtained by the surface bore object sensor 81 and this can be compared with the observed string profile which is determined by the riser adaptor bore object sensor 80.

As the drill string 21 is run down through each of the sensors 80, 81, a profile is generated of the change in diameters and by comparing the data from the surface bore object sensor 81 with the measured data from the riser adaptor bore object sensor 80, it is possible to determine which section of the drill string 21 is within the BOP. If necessary, additional bore object sensors could be located in other positions within the BOP or in the riser itself.

The bore object sensor is formed by using a non-metallic body 100, possibly formed from an epoxy, within which are mounted a set of emitters 101 and receivers 102. The emitters and receivers are connected to a microprocessor (not shown). Using an electrical pulse sent out by the emitters 101, a uniform electric field would be monitored by the receivers 102 if no object were present in the field of the sensor. However, when an object, such as the drill string, enters this field, the field flux lines 103 are disturbed and each receiver 102 can monitor the change in the electric field. When requiring to sense non metallic objects, the frequency will have to be varied. This allows the microprocessor to compute the closeness and the shape of the object to each of the receivers and therefore determine its size, shape, orientation and position within the bore.

The invention claimed is:

1. A system for determining the real time position of components within a bore, the system comprising:

a data sensor for obtaining data concerning the physical characteristics and profile of the components at a first location as the components run in the bore;

a sensing apparatus located, in use, within the bore and including a bore sensor for determining data concerning at least one physical characteristic or the profile of the components at a given time at a second location;

data storage for recording the obtained data and the determined data; and a processor for comparing the obtained data and the determined data to establish which of the components or part thereof is being sensed by the bore sensor at the second location.

2. A system according to claim 1, wherein the data sensor is arranged to accept information including the length, shape and/or diameter(s) of the components run in or out of the bore.

3. A system according to claim 1, wherein the data sensor is arranged to accept information including the distance between any change in diameter on a single component run in the bore.

4. A system according to claim 1, wherein the bore sensor determines the diameter and/or shape of the components at a given time.

5. A system according to claim 1, wherein the sensing apparatus further comprises another sensor for determining the distance between successive changes in diameter of tubular components.

6. A system according to claim 1, wherein the sensing apparatus includes a direction sensor for determining the direction of travel of the components within the bore.

7. A system according to claim 6, wherein the sensing apparatus includes a second bore sensor for determining the diameter of the components.

8. A system according to claim 1, further comprising a distance sensor for determining the distance travelled of equipment run in or out of the bore.

9. A system according to claim 1, wherein the processor is a microprocessor.

10. A system according to claim 1, wherein the bore is a subsea bore and the system further comprises a wellhead, a blow out preventer connected to the wellhead, a riser connecting the BOP with a drill rig, the drill rig including a travelling block/compensator attached to a derrick, draw works and a telescopic joint connecting the riser to the drill rig.

11. A system according to claim 10, further comprising a travel sensor on the telescopic joint for determining the relative movement between the riser and the drilling rig.

12. A system according to claim 10, further comprising a travel sensor for determining the relative movement of the top end of the riser and the rig.

13. A system according to claim 10, wherein the drill rig is located on a vessel and the sensing apparatus further includes:

a travel sensor on the telescopic joint to measure the movement between the rig and the riser;

a location sensor on the compensator to measure the movement between the component and the vessel;

a diameter sensor to measure the diameter of the component;

a motion sensor to measure the motion of the component relative to the wellhead; and a surface sensor to measure the length of the components.

14. A system according to claim 10 wherein the data sensor is located adjacent the rig and the sensing apparatus is located adjacent the wellhead.

15. A system according to claim 1, further comprising a visual display for displaying bore information to a user.

16. A system according to claim 1, wherein the bore sensor includes a plurality of emitters emitting flux lines and a plurality of receivers for receiving the flux lines.

17. A system for determining the real time position of components within a bore, the system comprising:

a sensor for obtaining data concerning the physical characteristics and profile of the components which are run into the bore at a run-in location;

a sensing means located, in use, within the bore and including a bore sensor for determining data concerning at least one physical characteristic or the profile of the components at a given time;

a data storage means for recording the obtained data and the determined data; and a comparison means for comparing the obtained data and the determined data to establish which part of the components is being sensed by the bore sensor; and wherein the bore is a subsea bore and the system further comprises a wellhead, a blow out preventer connected to the wellhead, a riser connecting the BOP with a drill rig, the drill rig including a travelling block/compensator attached to a derrick, draw works and a telescopic joint connecting the riser to the drill rig; and wherein the comparison means is arranged to determine the position of the components relative to a fixed point on the seabed.

18. A system determining the real time position of components extending through a telescopic joint and riser from a rig at a sea surface through a wellhead at the sea floor and into a well bore, the system comprising:

a distance sensor to determine the distance of travel of the components;

a travel sensor on the telescopic joint to measure relative movement between the rig and the riser;

a first sensor adjacent the rig to obtain data on the physical characteristics and profile of the components as they are run into the riser;

a second sensor adjacent the wellhead to determine data on the physical characteristics and profile of the components as they are run into the well bore; and a processor for comparing data from the sensors to establish which of the components or part thereof is being sensed by the second sensor, wherein a result of the comparison is displayed.

19. The system of claim 18 wherein the first sensor measures the length and diameter of the components.

20. A computer-readable medium containing software that, when executed by a processor, causes the processor to:

obtain first data from a first sensor at a first location sensing a component's characteristics;

obtain second data from a second sensor at a second location sensing the component's characteristics;

compare the first data with the second data to establish the component characteristics at the second location; and store a result of the comparison.

* * * * *